US005373789A

United States Patent [19]

Waizmann

[11] Patent Number: 5,373,789

[45] Date of Patent: Dec. 20, 1994

[54] APPARATUS FOR CLEANING CYLINDERS OF A ROTATING DRUM PRINTING MACHINE

[75] Inventor: Franz Waizmann, Gessertshausen, Germany

[73] Assignee: Baldwin-Gegenheimer GmbH, Augsburg, Germany

[21] Appl. No.: 994,314

[22] Filed: Dec. 21, 1992

[30] Foreign Application Priority Data

Dec. 20, 1991 [DE] Germany ..... 4142422

[51] Int. Cl.[5] ..... B41F 35/00

[52] U.S. Cl. ..... 101/423; 101/425

[58] Field of Search ..... 101/423, 424, 425

[56] References Cited

U.S. PATENT DOCUMENTS

| | | | |
|---|---|---|---|
| 4,651,644 | 3/1987 | Kaempfe et al. | 101/423 |
| 4,757,763 | 7/1988 | MacPhee et al. | 101/425 |
| 4,920,880 | 5/1990 | Hara et al. | 101/423 |
| 5,105,740 | 4/1992 | Loos et al. | 101/423 |
| 5,123,354 | 6/1992 | Loos | 101/425 |

FOREIGN PATENT DOCUMENTS

| | | |
|---|---|---|
| 712165 | 9/1941 | Germany . |
| 2052996 | 5/1972 | Germany . |
| 3005469 | 10/1980 | Germany . |
| 2047167 | 11/1980 | United Kingdom . |

*Primary Examiner*—Edgar S. Burr
*Assistant Examiner*—Anthony H. Nguyen
*Attorney, Agent, or Firm*—Darby & Darby

[57] ABSTRACT

An apparatus for cleaning cylinders of a rotating drum printing machine has a cleaning cloth, which can be unwound, and a contacting body. The cleaning, which otherwise is carried in fixed time regions, for which precisely dimensioned cloth sections can be made available, is changed to a measure, which is carried out with an alternating contacting pressure of the contacting body and a quasi continuous advance of the cloth. In the contacting zone, the cloth is taken hold of directly and pulled. An oscillating mechanism, which is preferably realized pneumatically, is provided for the alternating contacting pressure.

11 Claims, 5 Drawing Sheets

APPARATUS FOR CLEANING CYLINDERS OF A ROTATING DRUM PRINTING MACHINE

FIELD OF THE INVENTION

The invention relates to an apparatus for cleaning cylinders of a rotating drum printing machine.

BACKGROUND OF THE INVENTION

For cleaning the cylinder of rotating drum printing equipment, it is known to have a cleaning cloth that serves to take up dirt adhering to the cylinder to be cleaned. The cloth is brought into contact with the surface of the cylinder with the help of a contacting body, with the force exerted to achieve a frictional force being produced by an activatable driving mechanism.

The contacting force must provide the required contact pressure, at which a satisfactory cleaning result is achieved. The cleaning action is based on softening or dissolving the adhering dirt particles from dye residues and paper dust with the help of solvents while simultaneously rubbing off the particles.

The dirt and solvent are carried away by the cleaning cloth used, which is pressed against the cylinder in the axially extending contact zone. The capacity to absorb dirt is limited by the structure of the cloth fabric. For this reason, new, clean strips are supplied periodically to the cleaning zone. For this purpose, a cloth advance mechanism winds the cloth from a delivery roll to a dirt roll. At the dirt roll, the dirt, taken up by the cloth, is recovered as a wrapped-up layer. As long as a strip of the cleaning cloth is pressing against the cylinder, the rubbed-off dirt is collected and accumulated.

In the gap between the cloth and the cylinder, in which dirt is accumulating or piling up, shear forces arise, by which the dirt moves through the gap immediately when the forces are relieved. If the cylinder duct passes through the contact pressure zone, the dirt penetrates into the duct depression. The "banking-up pressure," exerted in the dirt gap, also does not permit the cloth to lie properly against the cylinder and to rub off the dirt.

OBJECT AND SUMMARY OF THE INVENTION

It is therefore an object of the invention to improve the handling of the accumulation of dirt in the gap between the rotating drum printing machine cylinder which is to be cleaned, and the contacting dirt absorption part.

Pursuant to the invention, the dirt is distributed over a larger piece of cleaning cloth. The strip of cloth in contact with the surface of the cylinder is enlarged. Because the cloth movement and the high contacting forces, which are required for cleaning and which restrain the cloth, are prevented, an increased area of cloth, which is available to the nominal surface of the cylinder that is calculated in partial circumferences or revolutions of the cylinder, is accomplished in a kinematic manner.

For this purpose, an alternating contacting pressure acts on the cloth in a quasi steady-state operation. The alternating contacting pressure starts out from the driving mechanism of the dirt take-up part. If the contacting pressure equipment moves back and forth, for example, with a cam or crank mechanism, maximum and minimum contacting pressures arise synchronously with this motion.

If this alternating contacting pressure is created by means of a medium which is set under pressure and acts on a membrane as a counter-pressure element, the alternating contacting pressure is generated by a corresponding change in the medium pressure.

The relationship between the normal or perpendicular contacting force produced by the contacting equipment and the frictional force that determines the motion of the cloth, permits coupling between the alternating action of the contacting force and the movement of the cloth. Corresponding to the increasing and decreasing contacting force, the cloth under tension is brought preferably into an increasing and a decreasing advancing motion.

The advancing motion of the cloth produces a sliding of the cloth on the counter pressure element. Between the rotating cylindrical shell surface and the advancing motion of the cloth, there is a considerable difference in speed. To reduce the stress that results when the cloth slides on the counter pressure element, it is possible to move the counter pressure element tangentially partially along with the cloth.

Due to the tension that is to be applied to the cloth, a contraction results in the stressed zone of the cloth, as a result of which the width of the cloth in the cleaning zone is less than the unstressed width of the cloth. This contraction is countered by keeping the pulling strand of the cleaning cloth as short as possible. For this purpose, a cloth clamping site is formed at the smallest possible parallel distance from the cleaning strip of the cleaning cloth. The main tensile force is introduced not at the winding up spindle, but at this clamping site. The clamping site, which arrests the cleaning cloth and moves with the cloth, is reset once again outside of the operating cycle of the cleaning apparatus.

The clamping site of the cloth in the tensile section between the cleaning strip and the take-up roller can be supplemented by a parallel disposed clamping site on the far side between the cloth unwinding device, the delivery roll and the cleaning strips. The first and second clamping sites are preferably linked with one another. For example, they may form a tenter frame that encloses the cleaning strip.

In order to reduce wear on the stressed sliding surface as the cloth slides on the contacting element, it is possible to dispose an intermediate layer between the cleaning cloth and the contacting element. This intermediate layer, which can be produced from a sheet of a low-friction material, can either rigidly cover the sliding surface of the cloth on the side of the contact element or be moved along with the cloth by means of appropriate fastening devices at said clamping sites.

With such an arrangement, the advantage arises that there is no rubbing and scraping action between the cleaning cloth and the contacting element.

The basic course of events during the cleaning of cylinders of a rotating drum printing machine is as follows. The cloth, which extends along a cylinder transversely to a contact zone, is pressed against the cylinder; the cloth is pulled through the contacting zone; the contacting pressure is alternately applied; the movement of the cloth is coupled with the alternating contacting pressure, so that increasing/decreasing partial lengths of cloth are moved through the contacting zone. The radial motion acting upon the counter-pressure element or the cyclically imposed pressure is coupled with the alternating course of the cloth movement. The cloth is moved under the influence of the reference variable of the friction, which alternates in value. The stressed unwound length of cloth in the contacting zone is made as short as possible by intermediate clamping.

The course of events of the movement or the pressure of the counter pressure element and the course of events of the movement of the cloth are constant in the ideal case and constantly alternating here. Under the conditions of practical operations, however, movement can also be not constant and jerky.

From a process engineering and objective point of view, several advantages arise from the invention, including improved dirt removal, a more uniform utilization of the cleaning cloth with a more uniform loading of the cloth by the dirt, a lower stress load on the rubber cloth that results in a longer service life of the rubber cloth and lesser amounts of dirt accumulated in the duct or in the pit of the cylinder are achieved.

BRIEF DESCRIPTION OF THE DRAWINGS

The following detailed description more readily explains an embodiment of the invention in conjunction with the following drawings, in which.

a) electrical motor, b) direct cloth drive (servo cylinder, tractor, pinfeed drum), and c) torsion drive.

DETAILED DESCRIPTION OF THE PREFERRED EMBODIMENTS

Figure 1:
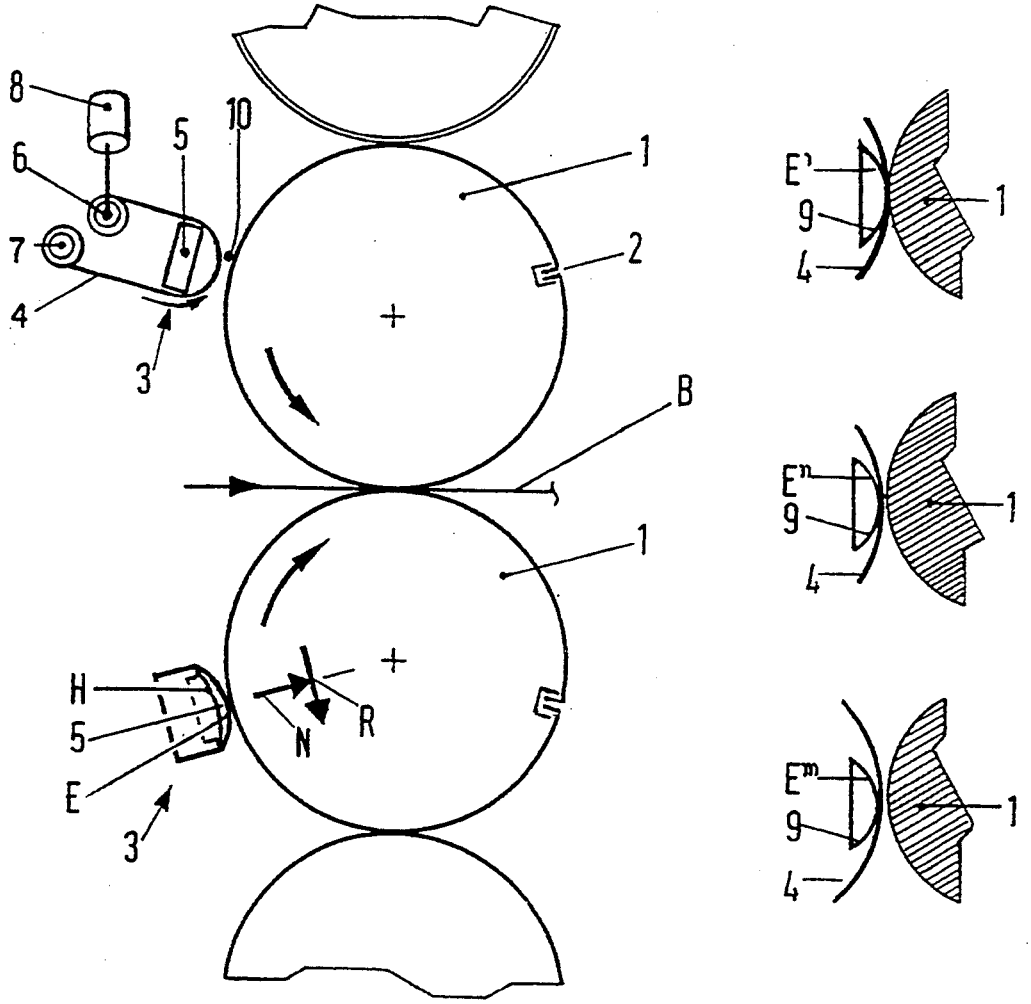
FIG. 1 shows contacting contours of contacting equipment of an apparatus for cleaning printing machine cylinders.

Cylinder 1 is a printing mechanism of a printing machine, for example, a blanket cylinder of a web-fed rotary offset printing press, which prints onto web B. Opposite the cylinder 1, a cleaning apparatus 3 is disposed, which is turned on and off for the purpose of cleaning the surface of the cylinder 1. The cylinder 1, which is covered with a stretched blanket, has a prestressing cut 2, which has dirt-absorbing edges that absorb dirt even when a filling piece (not shown) is used.

The cleaning apparatus 3 includes a contacting body 5. Between the cylinder 1 and the contacting body is a cleaning cloth 4, the unwinding of which from a delivery roll 7 to a winding up roller 6 is accomplished by a cloth driving mechanism 8. The mechanism 8 causes the cloth 4 to pass the cylinder 1 opposite the direction of rotation of cylinder 1. For the purpose of cleaning, the contacting body 5, which is provided with a counter-pressure element 9, is moved from a resting position H into the engagement position E, in which the cloth 4 is pressed against the cylinder 1. The engagement position E, which presupposes contact of the cloth 4, occurs under the action of a variable contacting pressure or a variables contacting normal force N, on which the frictional force R depends.

Instead of the thereby occurring variable surface pressure, the contours of several engagement positions E′, E″, E‴ have been drawn to illustrate harder and softer contact. At E′, the extreme contacting pressure of the cloth 4 exists. At E″, the contacting pressure is reduced and, as the tension takes hold, the cloth 4 can be moved more easily than in the case of position E′. In position E‴, there is still contact engagement; however, the cloth 4 is easily movable. As the distance between the contacting body 5 with the cloth 4 and the cylinder 2 is increased, the resting position H is assumed.

The direction of unwinding the cloth 4 and the direction of rotation of the cylinder 1 are preferably mutually opposite, although they can also be the same. The dirt collecting at the inlet gap 10 between the cylinder 1 and the cloth 4 attempts to pass through the contact pressure gap. On passing by the prestressing cut 2, there is partial relief of pressure, so that the dirt can penetrate into the depression that is available here.

The amount of dirt in the inlet gap 10 is limited, if a portion of it is carried away by way of the cloth 4 in the designated unwinding direction of the cloth 4. If the engagement position E is shifted from E′ to the "softer" positions E″, E‴, the unwinding of the cloth correspondingly changes over to an increasing advance speed w.

Figure 2:
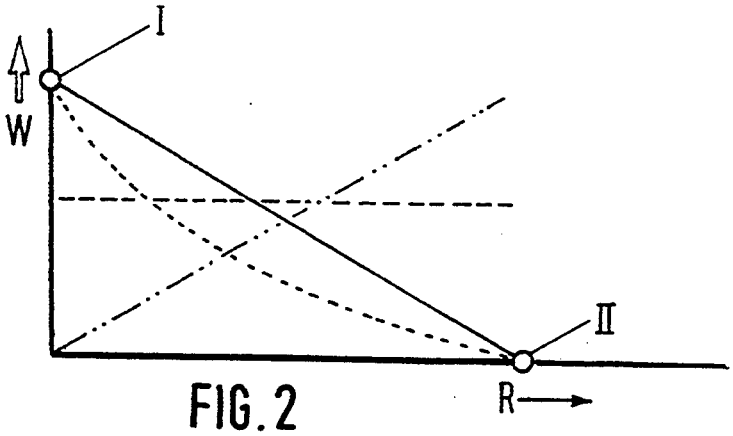
FIG. 2 shows a diagrammatic relationship between the cloth friction R (normal force/contacting pressure N) and the cloth advance speed w.

FIG. 2 shows the relationship between the cloth advance speed w and the frictional force R (N), R being the frictional force for the whole of the surface pressure. The point I on the y axis implies that, when the frictional force R=0, as it is, for example, in the resting position H of the cleaning apparatus 3, any advancing speeds w for transporting the soiled cloth strip away can be used. Point II on the x axis implies the use of an extreme friction force at a cloth advancing speed w of practically zero. The advance curve runs between the points I and II. (This advance curve can also rise progressively from approximately w=0; R=0; however, the most advantageous operation with the maximum advance at the highest contact pressure would be associated with excessive cloth contraction. Depending on the steady-state characteristics of the cloth driving mechanism 8, steady-state curves w(R) can also be set up, which run at a constant value or hyperbolically, as shown by the broken line.)

The contact between the cloth 4 and the cylinder 1 between solid contact pressure and the position of no contact, corresponding to E, E′, E″ and E‴ of the resting position H, is produced by the screw-down drive 11. The back and forth motion of the contacting body 5 of the cleaning apparatus 3 is brought about by means of a control cam 24 (FIG. 3*b*), which controls the deflection of the counter-pressure element 9 on the basis of time or phase.

Figure 3A:
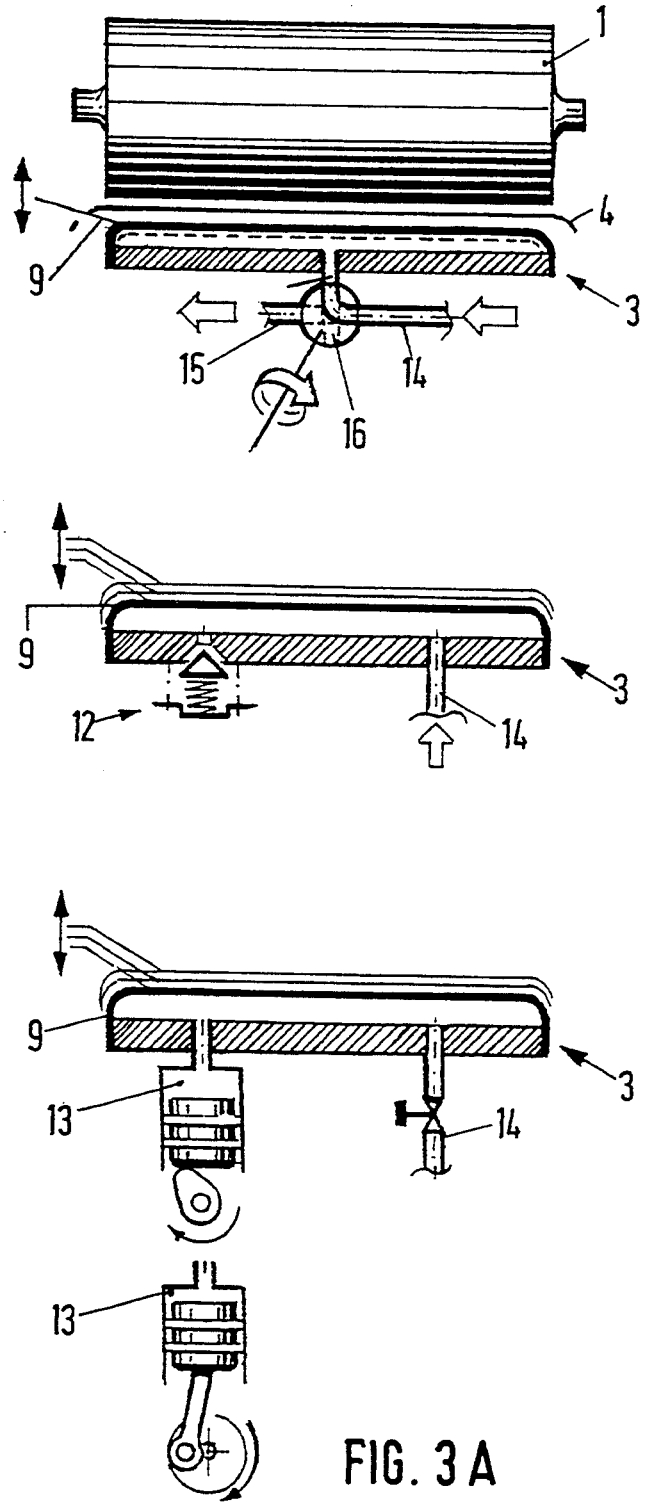
FIG. 3*a* shows a pneumatic embodiment of the alternating driving mechanism for the contacting equipment.
Figure 3B:
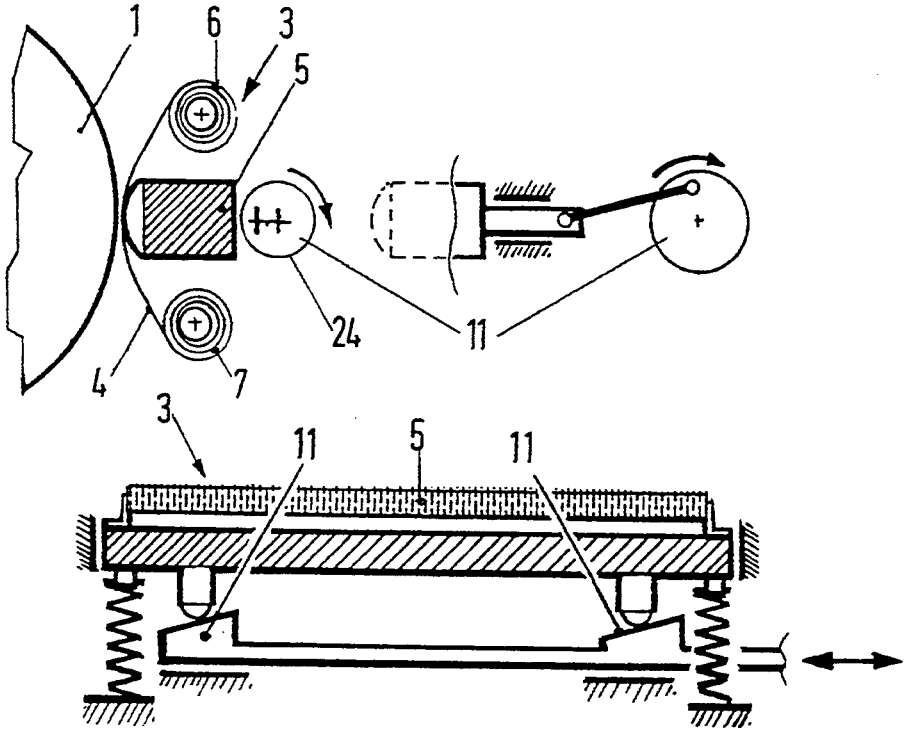
FIG. 3*b* shows a mechanical embodiment of the alternating driving mechanism for the contacting equipment.

According to FIG. 3*a*, the contacting body 5 is coupled with a cam drive or with a crank drive, which produces the back and forth motion. During the periodic rotational movement of the cam or the crank operation, the surface pressure of the cloth 4 changes in each case from a minimum to a maximum.

If the cleaning apparatus 3 is constructed as a cleaning beam with an elastic counter-pressure element 9, which is brought into the engagement position E by pressure or afflux and into the resting position H by relief of pressure or flowing away of the fluid, there is a pipeline system for supplying the fluid. The alternating internal pressure in the counter-pressure element 9 is preferably achieved by supplying a constant inlet pressure. The internal space of the counter-pressure element 9 is connected with a pressure control valve 12, the triggering value and the opening characteristics of which can be adjusted. The flowing in of the fluid with increasing contact pressure of the cloth 4, opening of the pressure control valve 12 with accompanying relief of the internal pressure and closing the pressure control valve 12 once again with renewed build-up of pressure alternate with one another.

Instead of constantly supplying the counter-pressure element 9 with a supplying pipeline that is taken over a reducing valve, a buffer 13 may also be installed, which increases and reduces the pressure by changing volume. To compensate for the pressure loss, the closed, corresponding volume, which connects the buffer volume and the internal space of the counter-pressure element 9, is provided with a supply of fluid. However, the consumption of, for example, compressed air is slight compared to the build up, which works with a leakage through the pressure control valve 12.

For the increasing and decreasing pressure with the advancing and retreating counter-pressure element 9, a two-way stopcock 16 may be placed in the supplying pipeline 14. By turning this two-way stopcock 16, compressed air can periodically flow into and out of the interior space of the contacting element 9 through the vent 15.

With the existing coupling of the cloth advance speed w with the alternating surface pressure through the counter-pressure element 9, the rotational movement of the two-way stopcock 16 is coupled at the same time with the cloth driving mechanism 8. According to FIG. 2, the cloth advance increases in the venting phase and decreases towards zero in the pumping up phase.

The winding up of the cloth with the winding-up roller 6 provides the tension, which is necessary for the movement of the cloth 4 when it is at a distance from the cylinder 1 and also when it is pressed against the cylinder 1, in which case it will have to overcome the force of friction R. The winding-up spindle 17 is connected on either side with motors, which drive over worm drives 18. Preferably, electric motors, such as 4-wire asynchronous motors or direct current shunt motors are used, since they have a relatively small size and are suitable for a space-saving installation of the cloth driving mechanism 8.

Figure 4A:
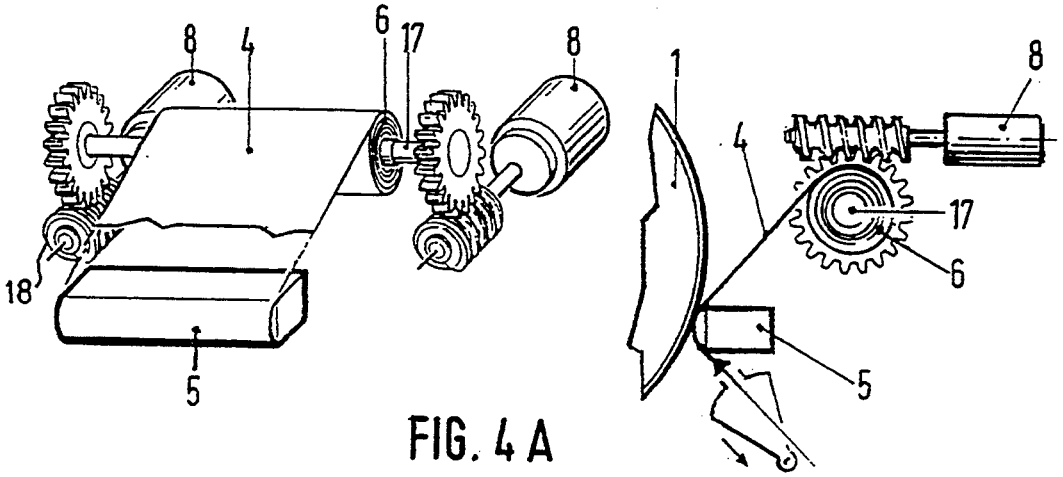
FIGS. 4*a*–4*c* show three embodiments of the rotating drive for the cloth winding-up roller, the three embodiments being.

The planned movement of the cloth 4 is in the peeling direction, opposite to the direction of rotation of the cylinder 1. With that direction of movement, the cloth 4 is tightened automatically against the tension brought about by the cloth driving mechanism 8. To ensure taut unwinding of the cloth 4, the delivery roller 7 is provided with an adjustable friction brake, which is indicated in FIG. 4*a* on the right hand side of the cloth inlet.

The rotational motion of the electric motors, that is, the cloth driving mechanism 8 can be controlled with respect to torque and the rotational speed by means of a pressure sensor mounted on the counter-pressure element 9, so that the steady-state curves of FIG. 2 can be fulfilled. For the steady-state curve with, for example, a constant advance speed w over the friction force R, the torque changes from a small value, when the contacting element 9 is at a distance from the cylinder 1 to a high value when the contact pressure is high.

According to a different embodiment for the rotating drive of the winding-up mechanism 6, a torsion bar 19 is provided in the interior of the winding-up roller 6. The principle of the torsion drive shows the rigid clamping of the torsion bar 19 within the winding-up roller 6 and a rotatable arrangement of bearings, which is provided with an operating lever 20, on one end of the torsion bar 19. A cloth driving mechanism 8, constructed as a linearly regulating servo drive 8.1, engages the operating lever 20. The clamping site of the operating lever 20 on the torsion bar 19 runs over a free-running hub or ratchet drive with detent pawl for shifting the operating lever 20 relative to the winding-up roller 6 that is to be rotated. When the servo drive 8.1 is operated, the torsion bar 19 is pretensioned, while the winding up roll 6 remains adapted to the unwinding.

To advance the cloth, the winding-up roller 6 is released by means of a coupling or a ratchet wheel 20.1, by means of which the winding up roller 6 moves into the pre-tension direction of the torsion bar 19, until arresting by means of the coupling 21 takes place once again.

The torsion drive has the advantage of a simple mechanical construction and a simple mode of action. If a two-sided detent pawl is used for the coupling 20.1—two sided in that one detent element is in engagement and one is not in engagement, as in the case of a balance wheel of a clock or watch—very small advance cycles of the cloth 4 can be realized. The spring element in the form of a torsion bar 19 can also be replaced or supplemented by a different spring element, such as a linear spring between the servo drive 8.1 and the operating lever 20.

Figure 4B:
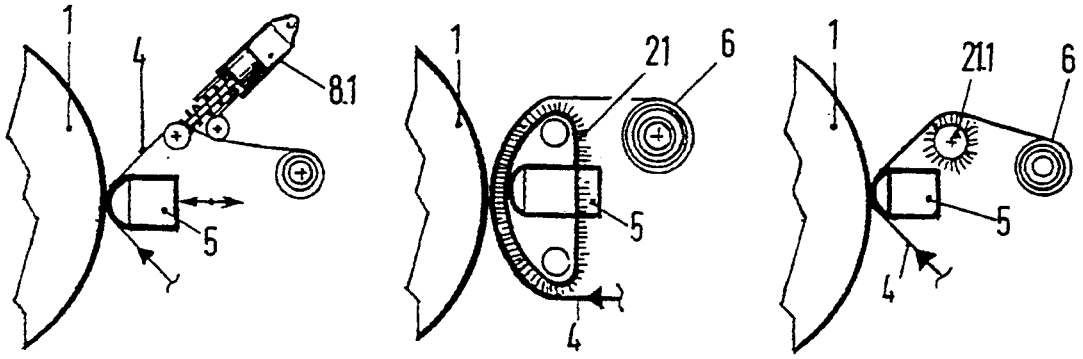
Figure 4C:
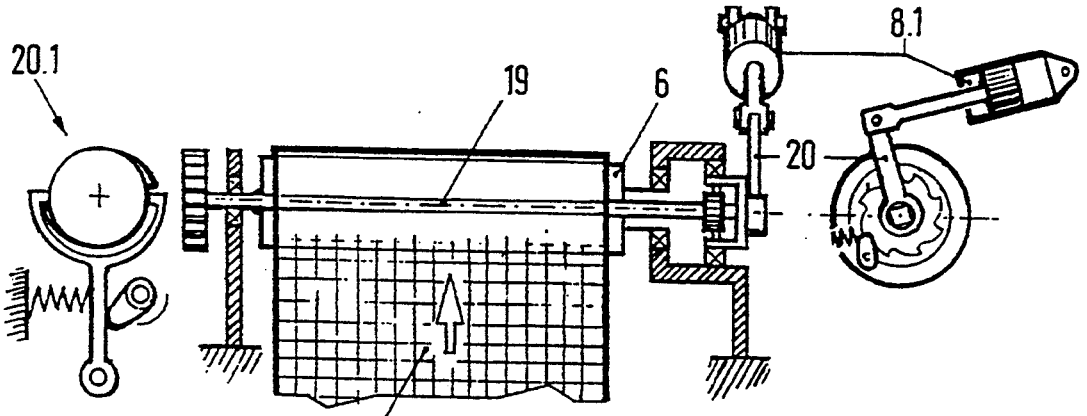

If the advance motion of the cloth 4 is to take place without the steady tension produced by a spring element, the servo drive 8.1 transfers the servo motor motion directly in short, rapid cycles directly onto the winding-up roller 6 (FIG. 4*b*).

The introduction of the tensile force for the advance of the cloth at the winding up spindle 17 is relatively indirect because of the winding layers of the cloth 4, since the actual piece of cloth 4, which is to be advanced, is limited only to the section in front of the counter-pressure element 9. For the direct introduction of the tension with respect to this section, a cloth tractor 21, formed from a sprocket drive endless loop, is disposed to the left and the right of the contacting body 5. The driven sprocket drive endless loop takes hold of the relevant section of the cloth 4 in the region of the counter-pressure element 9.

For the pre-shifting of the tensile engagement from the winding up spindle 17 closer to the counter-pressure element 9, it is also possible to place a driven pin feed drum 21.1, which engages the cloth over the whole width of the cloth, directly parallel next to the counter-pressure element 9 towards the winding up side (FIG. 4*b*).

Figure 5:
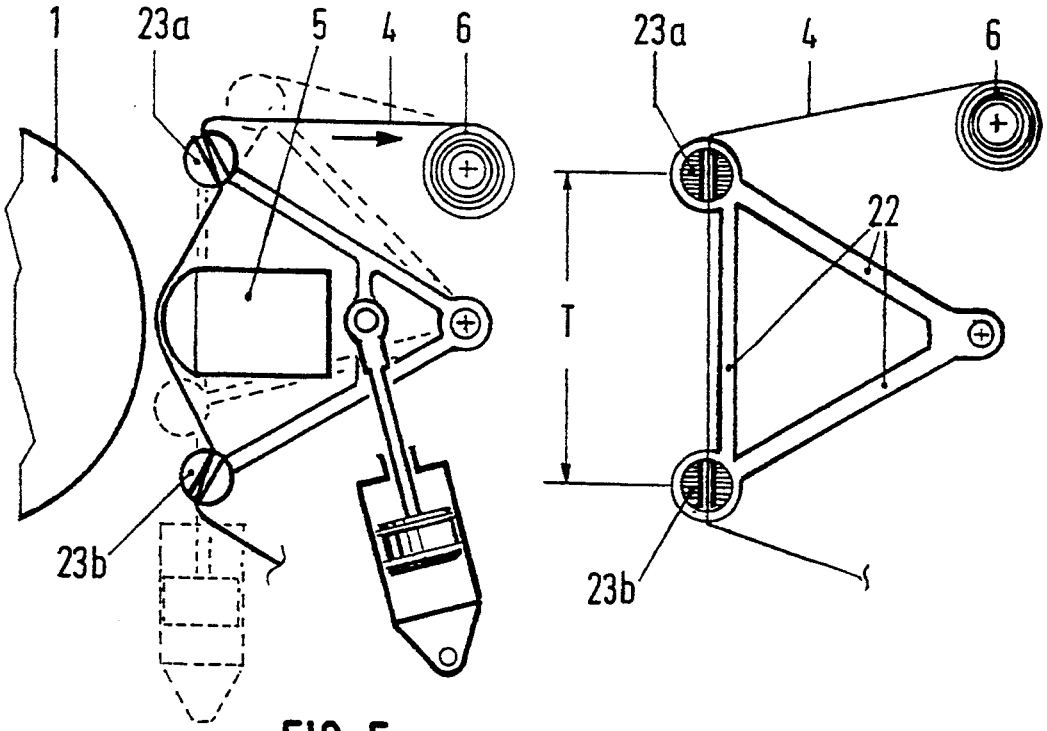
FIG. 5 shows the moving tenter with cloth section.

A different construction that limits of the loading on the cloth essentially to the compressed section of the cloth 4 consists of a tenter frame 22, which is window-shaped and extends in front of the counter-pressure element 9. Looked at in the unwinding direction of the cloth 4, the tenter frame 22 shows a clamping strip 23*a*, which is mounted in front of the counter-pressure element 9, and a clamping strip 23*b*, which is mounted behind the counter-pressure element 9. The clamping strips 23*a*, 23*b* form clamping sites for a clamped section T that extends between them. During an advance period, the cloth 4 moves from the start of the clamping section T to the end of the clamping section T. In the end position of the tenter frame 22 in the direction of the winding-up roller 6, the clamping strips 23*a*, 23*b* release the cloth, whereupon the tenter frame 22 is moved back into the starting position. In the starting position, the clamping strips 23*a*, 23*b* once again hold the cloth clamped tightly (FIG. 5).

The movement of the tenter frame 22 is either linear and, moreover, tangential to the counter-pressure element 9, or takes place with the help of a swivelling motion, which relates to the swivelling of the tenter frame 22 over an angular range.

The shifting of the tenter frame 22 in the direction of the delivery roll 7 is coupled with a loosing of the clamping sites 23*a*, 23*b* in an automatic manner according to the belt buckle principle. If the cloth 4 is pulled, the clamping is reinforced automatically by means of a clamping wedge or by a greater twisting around, which produces a higher friction. When the tension on the cloth 4 is slackened, the clamping connection is loosened and the tenter frame 22 can move back relative to the segment of cloth held between the winding-up roller 6 and the delivery roller 7.

When the tenter frame 22 is used, the essential cloth advance forces are expended by the tenter frame 22. The power of the driving mechanism for the tenter frame 22 is of decisive importance for overcoming the frictional forces existing during the contacting of the cloth 4 to the cylinder 1. The power of the driving mechanism thus is essential for forming the steady-state curves of FIG. 2. If the power of the driving mechanism is slight, the cloth 4 can be moved only if the contact with the cylinder 1 is relaxed. If the power of the driving mechanism is high, the advance motion of the cloth 4 is possible without hindrance even at high contacting pressure and strong contact, the frictional forces R being overcome.

What is claimed is:

1. An apparatus for cleaning a cylinder of a rotating drum printing machine, comprising:

a cleaning cloth;

a contacting body positioned such that said body exerts a variable force on said cylinder, said cloth being interposed between said body and said cylinder;

means for varying said force exerted by said body on said cylinder; and means for advancing said cloth at a variable speed in an inverse relationship to said force.

2. An apparatus as in claim 1, wherein said means for varying force comprises a rotating cam connected to said contacting body.

3. An apparatus as in claim 1, wherein said contacting body is a flexible membrane, said membrane being moved by pneumatic pressure provided by said means for varying force.

4. An apparatus as in claim 3, wherein said means for varying force comprises a multi-way stopcock.

5. An apparatus, as in claim 1, wherein said means for advancing comprises an electric motor having a variable speed.

6. An apparatus as in claim 1, further comprising a spring element for pretensioning and releasing said means for advancing said cloth depending on said force.

7. An apparatus as in claim 1 further comprising a delivery roll and a winding up roll, said cloth extending between said rolls, and a means for tensioning said cloth positioned between said rolls.

8. An apparatus as in claim 7, wherein said means for tensioning is comprised of a tenter frame with clamping strips.

9. An apparatus as in claim 7, wherein said means for tensioning is comprised of a cloth tractor.

10. An apparatus as in claim 7, wherein said means for tensioning is comprised of a pin-feed drum.

11. A method for operating a cleaning apparatus for a cylinder of a rotating drum printing machine, comprising the steps of:

applying a portion of a cloth to said cylinder with a force normal to said cylinder, said force oscillating between a maximum and a minimum;

moving said cloth at a varying speed such that another portion is applied to said cylinder, varying said speed in an inverse relationship to said force.

* * * * *